US010418173B2

(12) United States Patent
Yoshimori

(10) Patent No.: US 10,418,173 B2
(45) Date of Patent: Sep. 17, 2019

(54) COIL WINDING METHOD AND WINDING APPARATUS

(71) Applicant: SHT CORPORATION LTD., Osaka (JP)

(72) Inventor: Hitoshi Yoshimori, Osaka (JP)

(73) Assignee: SHT Corporation Limited, Osaka (JP)

( * ) Notice: Subject to any disclaimer, the term of this patent is extended or adjusted under 35 U.S.C. 154(b) by 434 days.

(21) Appl. No.: 15/268,358

(22) Filed: Sep. 16, 2016

(65) Prior Publication Data

US 2017/0069424 A1 Mar. 9, 2017

Related U.S. Application Data

(60) Division of application No. 14/149,778, filed on Jan. 7, 2014, now abandoned, which is a continuation of (Continued)

(30) Foreign Application Priority Data

Jul. 8, 2011 (JP) ..... 2011-151444

(51) Int. Cl.
*H01F 41/064* (2016.01)
*B21F 3/10* (2006.01)
(Continued)

(52) U.S. Cl.
CPC ..... *H01F 41/064* (2016.01); *B21F 3/10* (2013.01); *H01F 5/00* (2013.01); *H01F 41/086* (2016.01); *H01F 41/098* (2016.01)

(58) Field of Classification Search
CPC .... H01F 41/064; H01F 41/086; H01F 41/098; B21F 3/00
(Continued)

(56) References Cited

U.S. PATENT DOCUMENTS

2003/0098380 A1* 5/2003 Nagai ..... H01F 41/064 242/437.3
2013/0277493 A1* 10/2013 Yamaguchi ..... H01F 41/098 242/604

FOREIGN PATENT DOCUMENTS

JP 07183152 7/1995 ..... H01F 41/06
JP 2003-86438 3/2003 ..... H01F 30/00
(Continued)

OTHER PUBLICATIONS

International Search Report issued in corresponding foreign application, PCT/JP2012/066327, 1 page (dated Oct. 2, 2012).

*Primary Examiner* — Pradeep C Battula
(74) *Attorney, Agent, or Firm* — J. Peter Paredes; David G. Rosenbaum; Rosenbaum IP, P.C.

(57) ABSTRACT

The present invention is to provide a plurality of unit coil portions formed by winding one conductive wire about a winding axis is placed side by side in the winding axis direction, each of the unit coil portions is formed by unit wound portions having different inner circumferential lengths from each other, the unit coil portion is multi-layered in at least a part thereof by pushing at least a part of the unit wound portion having a small inner circumferential length inside the unit wound portion having a large inner circumferential length, and the unit wound portion is wound along a loop shape winding route having a plurality of arc shape corner parts. In unit wound portions forming the unit coil portion, corner parts formed at the same phase angle with respect to the winding axis are formed in an arc shape having curvature center at the same position.

3 Claims, 14 Drawing Sheets

Related U.S. Application Data application No. PCT/JP2012/066327, filed on Jun. 27, 2012.

(51) Int. Cl.
*H01F 5/00* (2006.01)
*H01F 41/086* (2016.01)
*H01F 41/098* (2016.01)

(58) Field of Classification Search
USPC ..... 140/71 R, 71 C
See application file for complete search history.

(56) References Cited

FOREIGN PATENT DOCUMENTS

| | | | | |
|---|---|---|---|---|
| JP | 2006-288025 | 10/2006 | | |
| JP | 2006-339407 | 12/2006 | ..... | H01F 41/06 |
| JP | 2009-302245 | 12/2009 | ..... | H01F 41/06 |

* cited by examiner

PRIOR ART

COIL WINDING METHOD AND WINDING APPARATUS

CROSS-REFERENCE TO RELATED APPLICATIONS

The present application claims priority from and is a divisional from U.S. patent application Ser. No. 14/149,778, filed Jan. 7, 2014; which is a continuation from PCT Application No. PCT/JP2012/066327, filed Jun. 27, 2012; which claims priority from Japanese Patent Application Serial No. JP 2011-151444, filed Jul. 8, 2011, all herein incorporated by reference in their entireties.

BACKGROUND

The present invention relates to a winding method and a winding apparatus of a coil including a plurality of coil layers.

As shown in FIG. 17, the applicant developed a coil 2 in which unit coil portions 23 formed by winding a conductive wire 22 in a swirl form are repeatedly placed side by side in the winding axis direction.

As a manufacturing method of such a coil 2, a method of continuously forming a first unit wound portion 25, a second unit wound portion 26, and a third unit wound portion 27 having different inner circumferential lengths from each other in the winding axis direction by winding a conductive wire in a swirl form as shown in FIG. 18 A, and continuously forming unit coil portions including the pluralities of unit wound portions 25, 26, 27 in the winding axis direction, so as to manufacture an interim product 20 of an air core coil, and then compressing the interim product 20 in the winding axis direction, pushing at least a part of the second unit wound portion 26 inside the third unit wound portion 27, and pushing at least a part of the first unit wound portion 25 inside the second unit wound portion 26 as in FIG. 18 B, so as to obtain a finished product 21 of the air core coil including a plurality of coil layers (three layers in the example of the figure) is known (Japanese Patent Laid-open Publication No. 2003-86438).

As a method of manufacturing the interim product 20 of the air core coil shown in FIG. 18 A, the method of using a stepped winding jig corresponding to a hollow shape of the interim product 20 (Japanese Patent Laid-open Publication No. 2003-86438) and an automatic winding machine for winding a conductive wire around a winding core member while changing a form of the winding core member for each wire winding step of a unit wound portion (Japanese Patent Laid-open Publication No. 2006-339407) are known.

However, with the method of using the stepped winding jig, a winding task is a manual task. Thus, there is a problem that production efficiency is bad.

With the automatic winding machine for winding the conductive wire around the winding core member while changing the form of the winding core member for each wire winding step of the unit wound portion, there is a problem that a configuration for changing the form of the winding core member for each wire winding step of the unit wound portion is complicated.

SUMMARY OF THE INVENTION

Provided herein are systems, methods and apparatuses for a coil in which a plurality of unit wound portions having different inner circumferential lengths from each other is continuously formed in the winding axis direction, each of the unit wound portions is wound along a loop shape winding route having a plurality of arc shape corner parts, and unit coil portions including the pluralities of unit wound portions are continuously formed in the winding axis direction, wherein the pluralities of corner parts formed at the same phase angle with respect to the winding axis in the plurality of unit wound portions forming each of the unit coil portions are formed in an arc shape having curvature center at the same position.

The methods, systems, and apparatuses are set forth in part in the description which follows, and in part will be obvious from the description, or can be learned by practice of the methods, apparatuses, and systems. The advantages of the methods, apparatuses, and systems will be realized and attained by means of the elements and combinations particularly pointed out in the appended claims. It is to be understood that both the foregoing general description and the following detailed description are exemplary and explanatory only and are not restrictive of the methods, apparatuses, and systems, as claimed.

BRIEF DESCRIPTION OF THE DRAWINGS

In the accompanying figures, like elements are identified by like reference numerals among the several preferred embodiments of the present invention.

FIG. 9 B is a perspective view for illustrating actions of the shaft body.

FIG. 9 C is a perspective view for illustrating actions of the shaft body.

FIG. 18 B is a view showing a compression step where a finished product is obtained from the interim product of the coil.

DETAILED DESCRIPTION OF THE INVENTION

Figure 1:
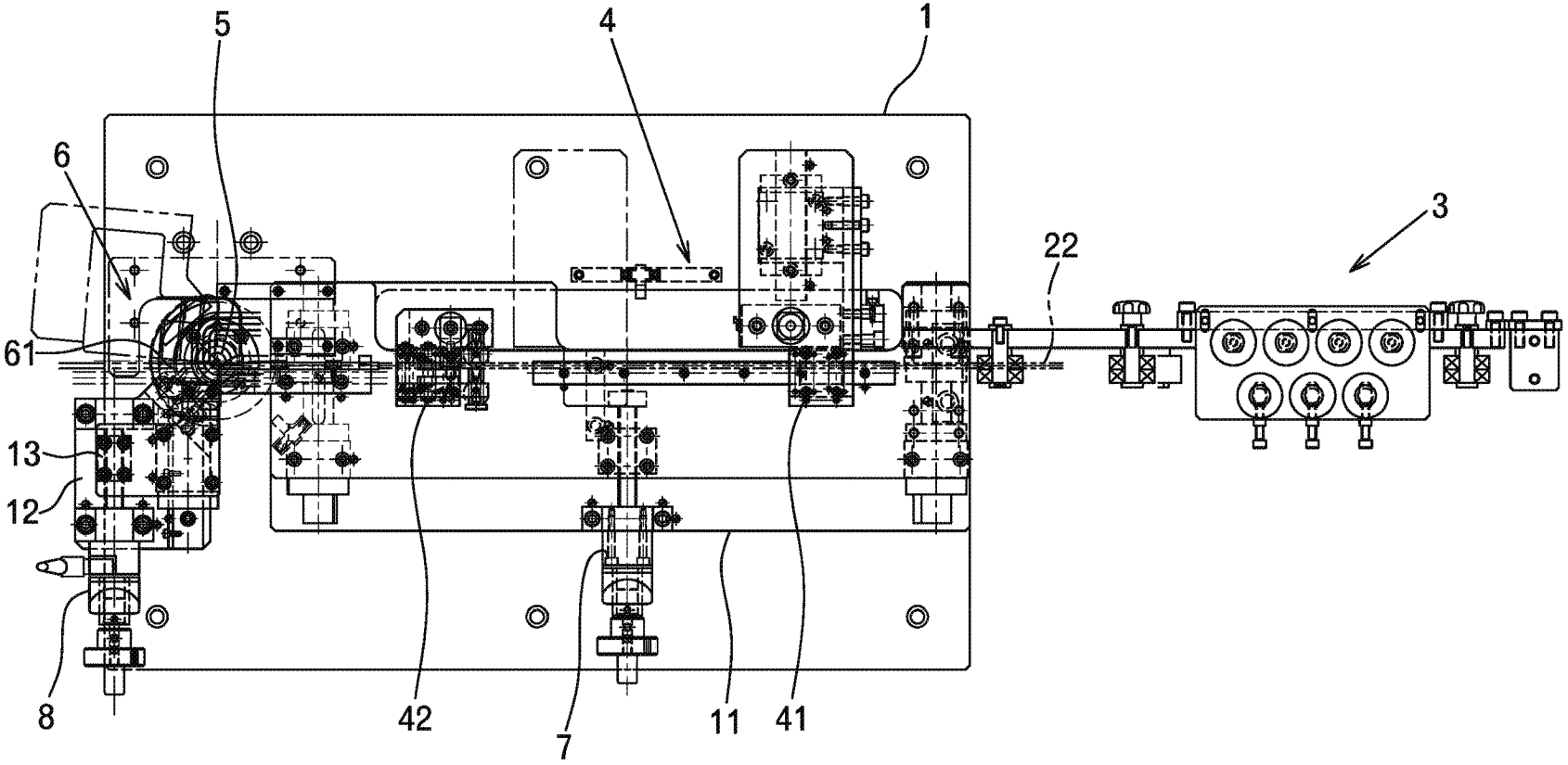
FIG. 1 is a plan view showing the entire winding apparatus of a coil according to the present invention.

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

An object of the present invention is to provide a winding method and a winding apparatus of a coil, capable of manufacturing a coil in which unit coil portions including pluralities of unit wound portions having different inner circumferential lengths from each other are continuously formed in the winding axis direction with a simple configuration.

Solving the Problems

In a coil according to the present invention, a plurality of unit coil portions formed by winding one conductive wire about a winding axis is placed side by side in the winding axis direction, each of the unit coil portions is formed by a plurality of unit wound portions having different inner circumferential lengths from each other, the unit coil portion is multi-layered in at least a part thereof by pushing at least a part of the unit wound portion having a small inner circumferential length inside the unit wound portion having a large inner circumferential length, and the unit wound portion is wound along a loop shape winding route having a plurality of arc shape corner parts.

In the plurality of unit wound portions forming the unit coil portion, pluralities of corner parts formed at the same phase angle with respect to the winding axis are formed in an arc shape having curvature center at the same position.

A winding method of a coil according to the present invention is a winding method of a coil in which a plurality of unit coil portions formed by winding one conductive wire about a winding axis is placed side by side in the winding axis direction, each of the unit coil portions is formed by a plurality of unit wound portions having different inner circumferential lengths from each other, the unit coil portion is multi-layered in at least a part thereof by pushing at least a part of the unit wound portion having a small inner circumferential length inside the unit wound portion having a large inner circumferential length, and the unit wound portion is wound along a loop shape winding route having a plurality of arc shape corner parts, including a first step of transferring a conductive wire 22 by a predetermined distance along a straight transition path crossing a shaft body 5, and fitting the conductive wire 22 along an outer circumferential surface of the shaft body 5, and a second step of winding the conductive wire 22 on the outer circumferential surface of the shaft body 5 by a predetermined angle by rotating a pressing member 61 to be pressed onto the conductive wire 22 along a circumferential route about the shaft body 5, so as to form arc shape corner parts, wherein one unit wound portion is formed by repeating the first step and the second step by the number of times of the corner parts, and by changing an outer diameter of the shaft body 5 at the time of formation of the unit wound portions in a process of forming one unit coil portion, the pluralities of corner parts formed at the same phase angle with respect to the winding axis in the plurality of unit wound portions forming the unit coil portion are formed in an arc shape having curvature center at the same position and having different radiuses.

In a specific mode, the winding method has a third step of, after manufacturing the coil in which the unit coil portions including the pluralities of unit wound portions are continuously formed in the winding axis direction, compressing the coil in the winding axis direction and pushing at least a part of the unit wound portion having a small inner circumferential length inside the unit wound portion having a large inner circumferential length among the plurality of unit wound portions forming the unit coil.

Thereby, the unit coil portion is multi-layered in at least a part thereof.

A winding apparatus of a coil according to the present invention is a winding apparatus of a coil in which a plurality of unit coil portions formed by winding one conductive wire about a winding axis is placed side by side in the winding axis direction, each of the unit coil portions is formed by a plurality of unit wound portions having different inner circumferential lengths from each other, the unit coil portion is multi-layered in at least a part thereof by pushing at least a part of the unit wound portion having a small inner circumferential length inside the unit wound portion having a large inner circumferential length, and the unit wound portion is wound along a loop shape winding route having a plurality of arc shape corner parts, the apparatus including; a shaft body 5, a conductive wire transfer mechanism 4 for transferring a conductive wire 22 along a straight transition path crossing the shaft body 5, and fitting the conductive wire 22 along an outer circumferential surface of the shaft body 5, and a bending mechanism 6 for bending the conductive wire 22 along the outer circumferential surface of the shaft body 5 by rotating a pressing member 61 to be pressed onto the conductive wire 22 along a circumferential route about the shaft body 5.

In a specific mode, the shaft body 5 is formed by a plurality of shaft portions 51, 52, 53 arranged on the same axis as the winding axis, and the shaft body 5 is connected to a driving and reciprocating mechanism for letting, with respect to the center shaft portion 51, the other shaft portions 52, 53 respectively reciprocate and move along the winding axis.

In another specific mode, a guide plate 9 surrounding the shaft body 5 for guiding the conductive wire 22 bent into a loop shape by the bending mechanism 6 is installed.

In a further specific mode, a surface of the guide plate 9 has an inclination in accordance with a lead angle of the unit wound portions with respect to a surface orthogonal to the shaft body 5.

Effects

With the coil manufactured by the winding method and the winding apparatus of the coil according to the present invention, the pluralities of corner parts formed at the same phase angle with respect to the winding axis in the plurality of unit wound portions forming the unit coil portion are formed in an arc shape having the curvature center at the same position. Thus, when the unit coil portion is multi-layered in at least a part thereof, a space between the unit wound portion on the inner side and the unit wound portion on the outer side comes as close to zero as possible in the multi-layered part. As a result, a space factor of the conductive wire is increased.

Hereinafter, a winding method and a winding apparatus for manufacturing an interim product 20 of an air core coil shown in FIG. 18 A will be specifically described along the drawings. It should be noted that in FIG. 1, a conductive wire 22 is transferred from the right to the left along a straight line on a horizontal plane.

In the winding apparatus according to the present invention, as shown in FIG. 1, a first reciprocating platform 11 slidable in the front and rear direction which is orthogonal to a transition path of the conductive wire 22 is arranged on a base 1 having a horizontal surface, and a shaft body 5 protruding vertically upward and a rotation platform 12 rotatable about the shaft body 5 within a range of an angle exceeding 90 degrees are arranged on the left side of the first reciprocating platform 11.

Figure 6:
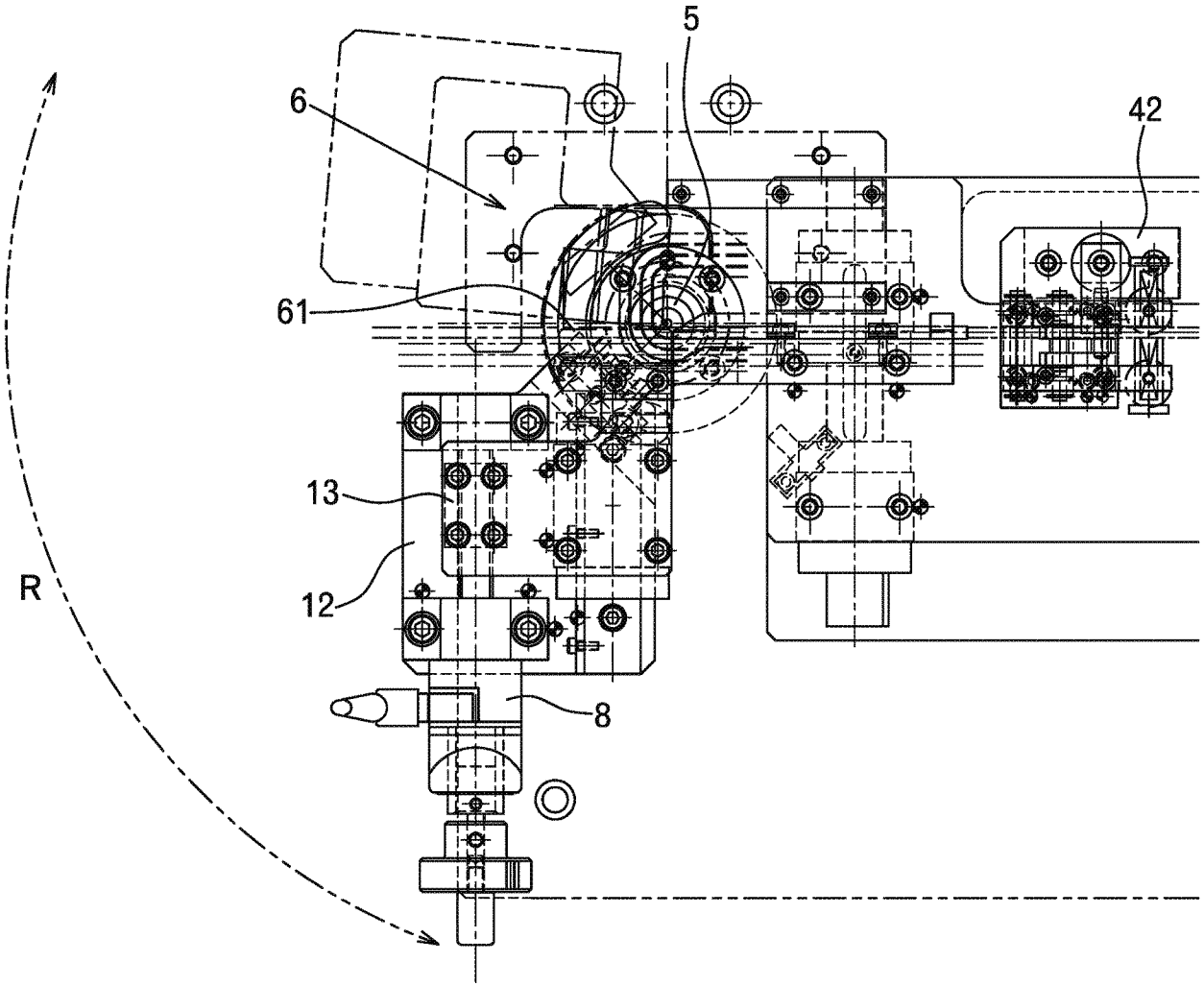
FIG. 6 is a plan view of the shaft body and the peripheral mechanisms thereof.

A second reciprocating platform 13 slidable in the front and rear direction at an initial position of the rotation platform 12 shown in FIG. 1 is arranged on the rotation platform 12. In the second reciprocating platform 13, as shown in FIG. 6, a pressing member 61 capable of pressing the conductive wire 22 is attached to an end on the side of the shaft body 5.

Figure 3:
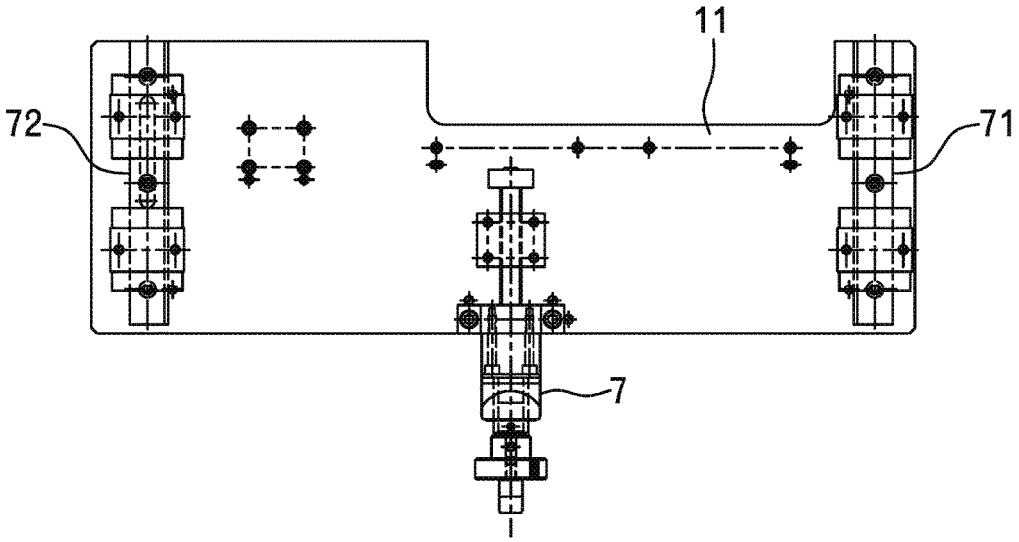
FIG. 3 is a plan view of a first reciprocating platform.
Figure 4:
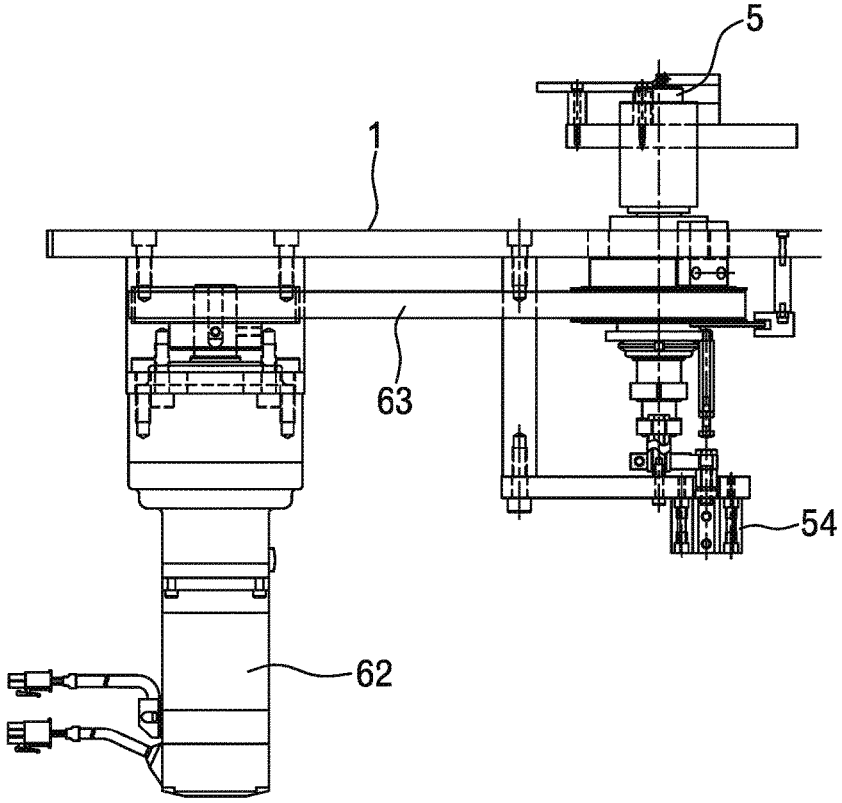
FIG. 4 is a front view of a shaft body and peripheral mechanisms thereof.

The first reciprocating platform 11 includes a pair of reciprocating guide mechanisms 71, 72 in left and right ends thereof as shown in FIG. 3, and can be moved forward and rearward by an arbitrary distance by a first driving and reciprocating mechanism 7. The second reciprocating platform 13 can be moved forward and rearward by an arbitrary distance by a second driving and reciprocating mechanism 8 shown in FIG. 1. A motor 62 is connected to the rotation platform 12 via a belt mechanism 63 shown in FIG. 4. Thereby, a bending mechanism 6 for winding the conductive wire 22 on an outer circumferential surface of the shaft body 5 is formed.

In the first reciprocating platform 11, a conductive wire feeding mechanism 3 for feeding the conductive wire 22 from the upstream side toward the downstream side is coupled to a right end on the upstream side of the conductive wire 22.

Figure 2:
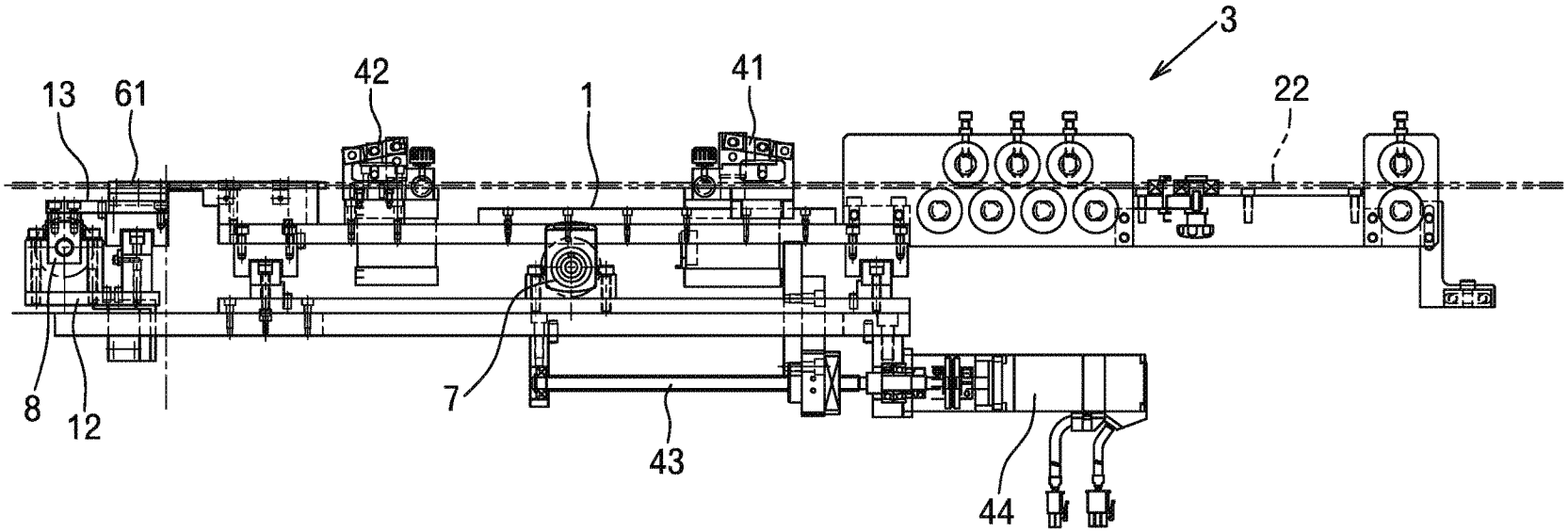
FIG. 2 is a front view showing the entire winding apparatus.

A conductive wire transfer mechanism 4 is arranged along the transition path of the conductive wire 22 on the first reciprocating platform 11. The conductive wire transfer mechanism 4 includes a first grip mechanism 41 and a second grip mechanism 42. A motor 44 is coupled to the first grip mechanism 41 via a shaft 43 shown in FIG. 2, and by drive of the motor 44, the first grip mechanism 41 reciprocates and moves along the transition path of the conductive wire 22.

By moving from a downstream position to the upstream side in a state of gripping the conductive wire 22, the first grip mechanism 41 transfers the conductive wire 22 in accordance with a moving distance thereof, and then returns to the original downstream position in a state of not gripping the conductive wire 22. The second grip mechanism 42 does not grip the conductive wire 22 while the first grip mechanism 41 grips the conductive wire 22, and grips the conductive wire 22 while the first grip mechanism 41 does not grip the conductive wire 22.

Figure 5:
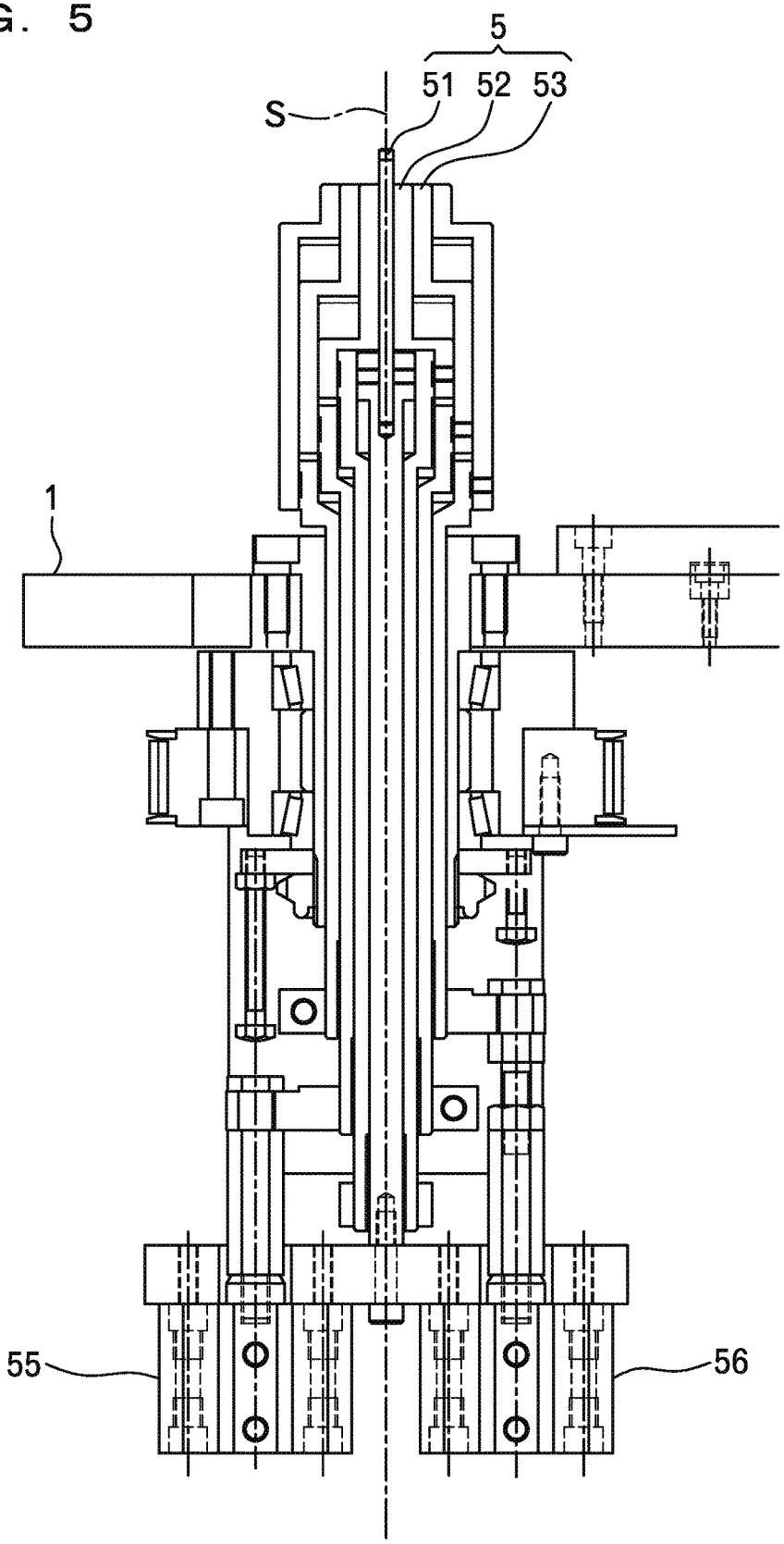
FIG. 5 is a sectional view of the shaft body.

The shaft body 5 is arranged along the transition path of the conductive wire 22, and as shown in FIG. 5, includes a round rod shape first shaft portion 51, a cylindrical second shaft portion 52, and a cylindrical third shaft portion 53 coaxially about a winding axis S. The first shaft portion 51 is connected to a first driving and reciprocating mechanism 54 shown in FIG. 4, and the second shaft portion 52 and the third shaft portion 53 are respectively connected to a second driving and reciprocating mechanism 55 and a third driving and reciprocating mechanism 56 shown in FIG. 5.

Figure 9A:
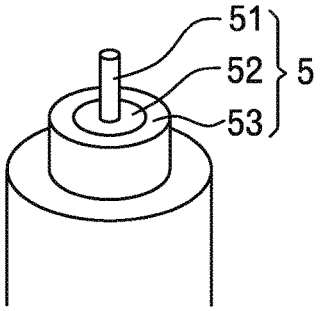
FIG. 9 A is a perspective view for illustrating actions of the shaft body.
Figure 9B:
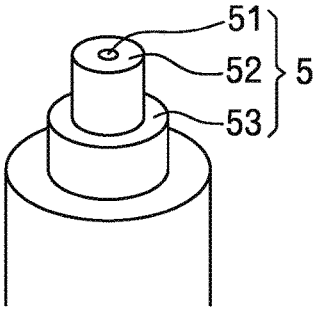
Figure 9C:
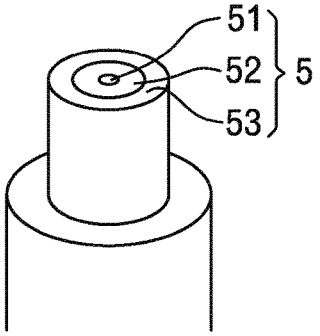

Thereby, a first state where only the first shaft portion 51 protrudes as in FIG. 9 A, a second state where the first shaft portion 51 and the second shaft portion 52 protrude as in FIG. 9 B, and a third state where the first shaft portion 51, the second shaft portion 52, and the third shaft portion 53 protrude as in FIG. 9 C can be realized.

Figure 10:
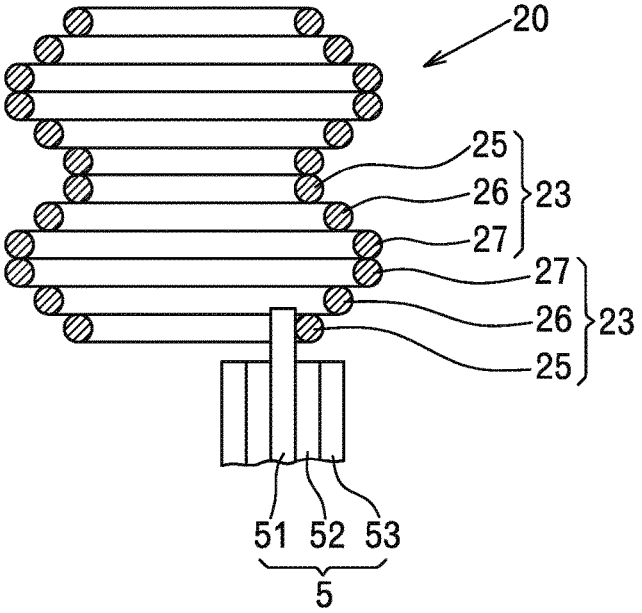
FIG. 10 is a sectional view for illustrating a size relationship between the shaft body and a coil interim product.
Figure 11:
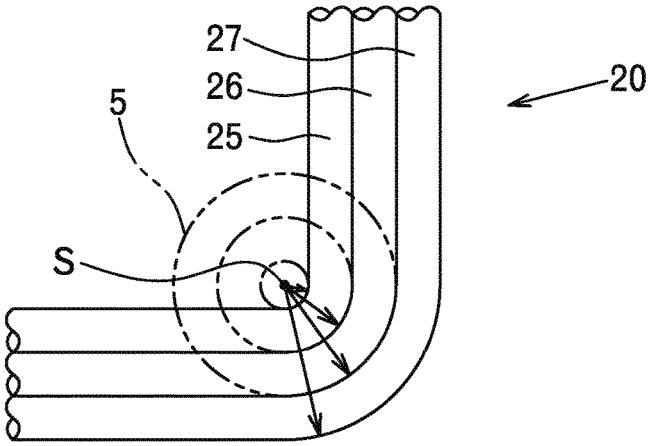
FIG. 11 is an enlarged plan view showing corner parts of the coil interim product.
Figure 12:
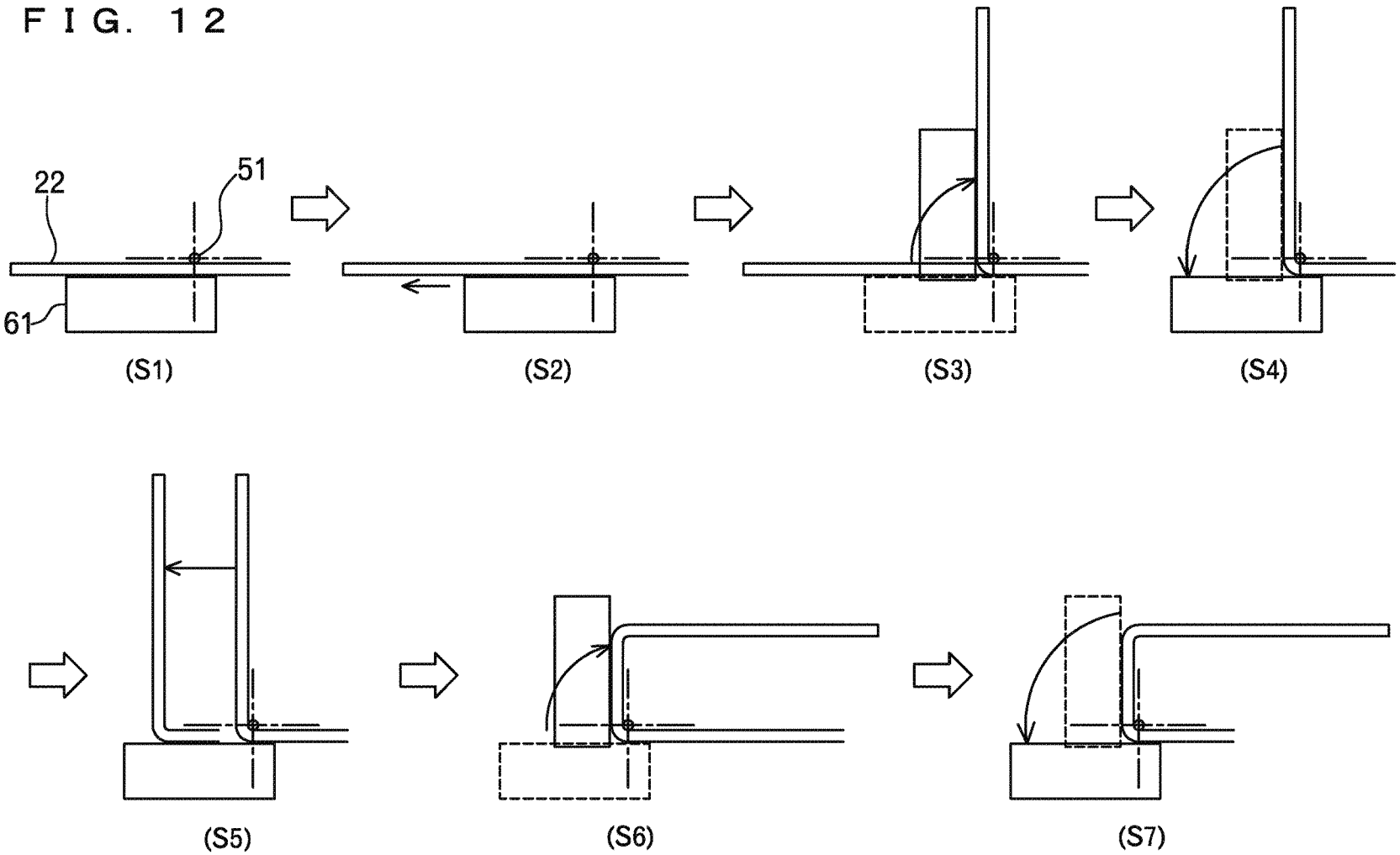
FIG. 12 is a series of plan views for illustrating a first stage of a winding step of the coil.
Figure 13:
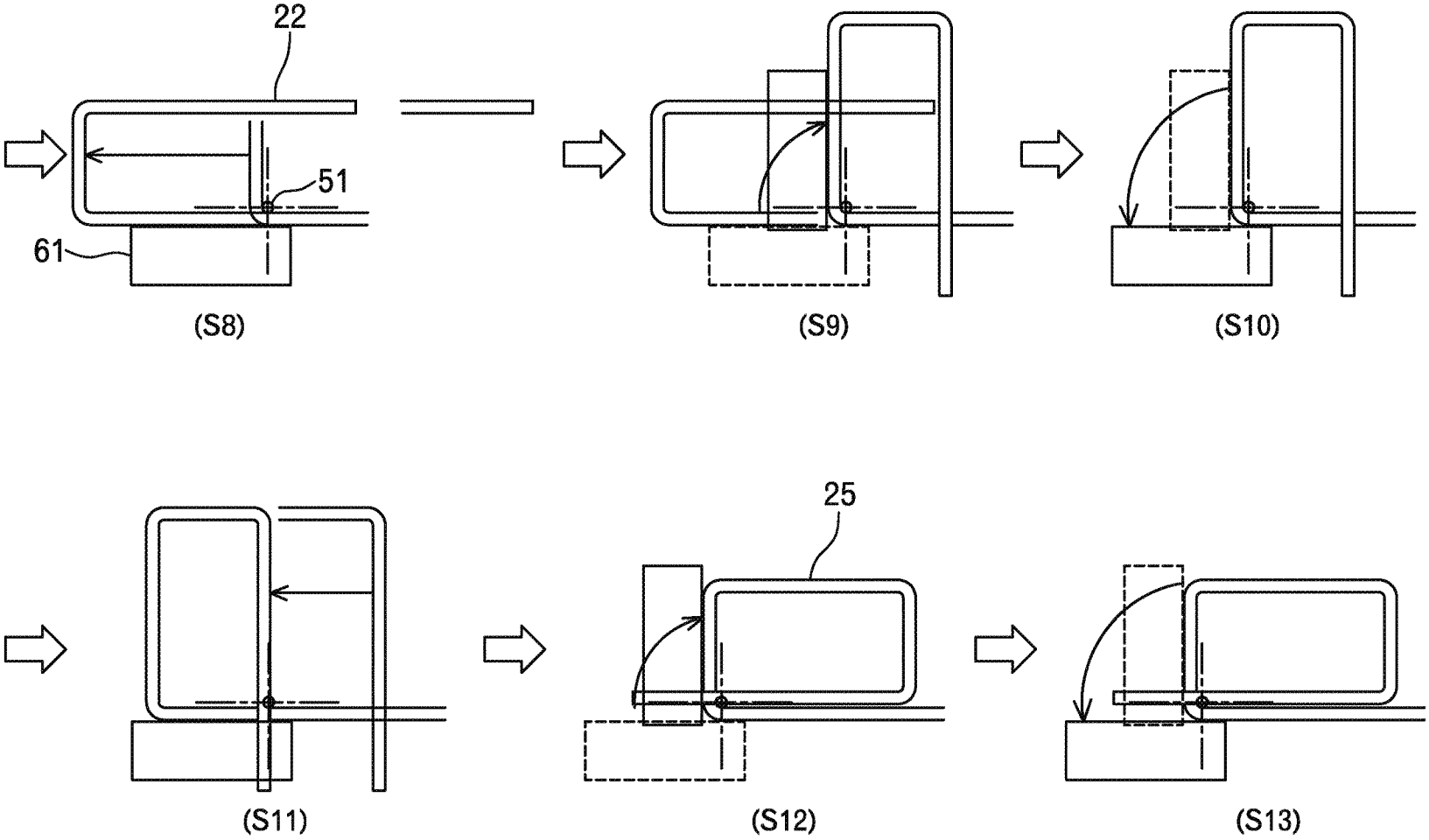
FIG. 13 is a series of plan views for illustrating a second stage of the winding step of the coil.
Figure 14:
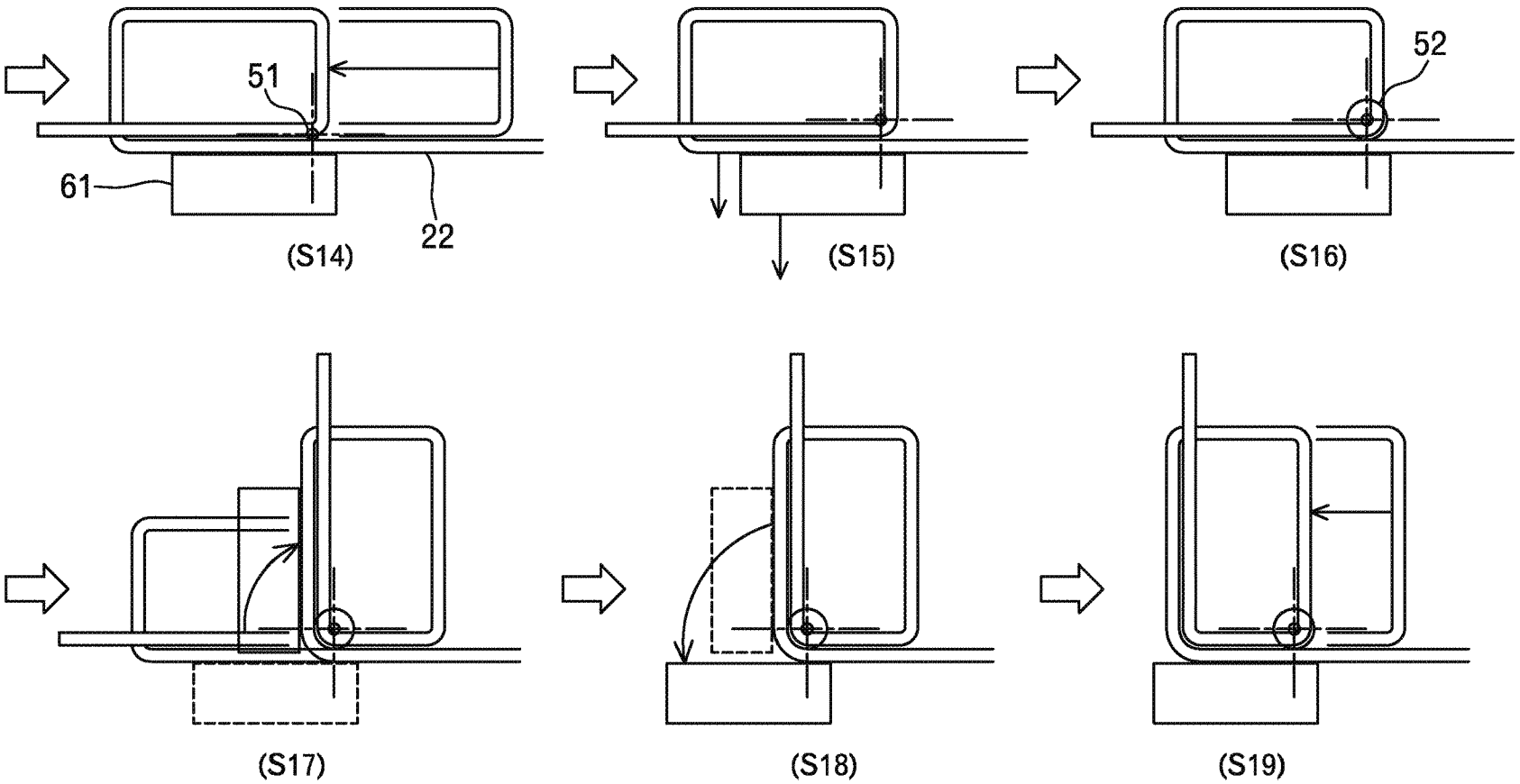
FIG. 14 is a series of plan views for illustrating a third stage of the winding step of the coil.
Figure 15:
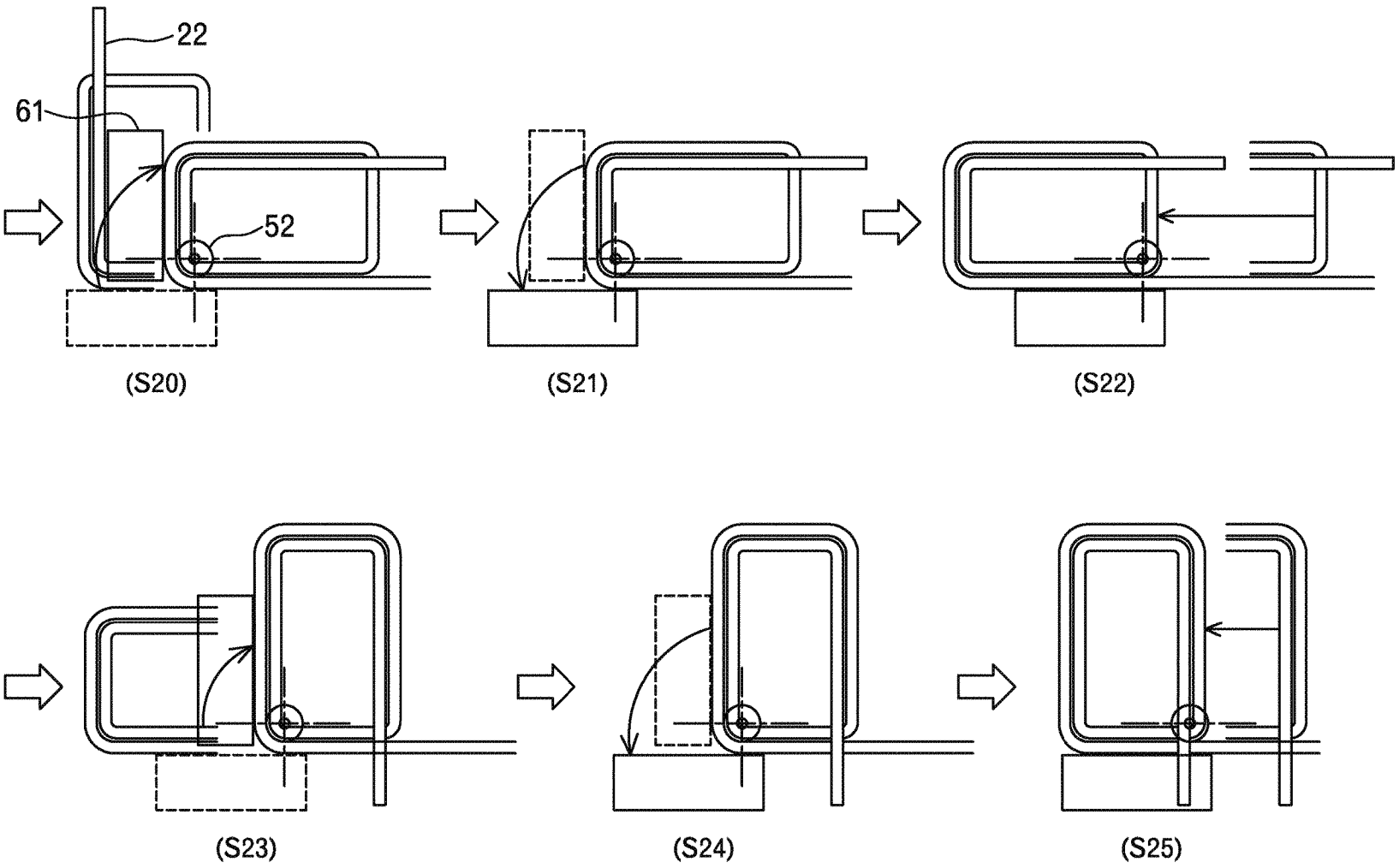
FIG. 15 is a series of plan views for illustrating a fourth stage of the winding step of the coil.
Figure 16:
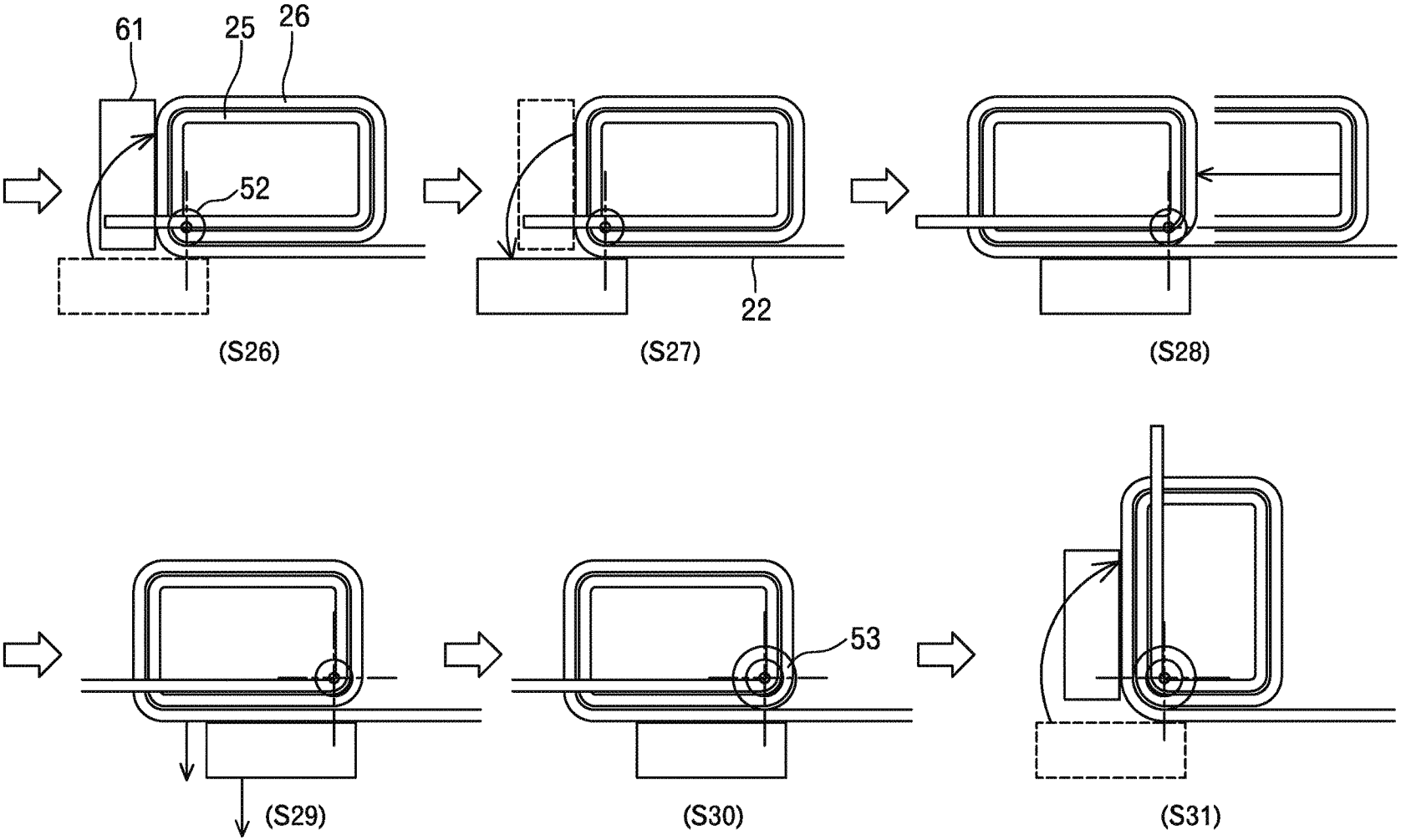
FIG. 16 is a series of plan views for illustrating a fifth stage of the winding step of the coil.
Figure 17:
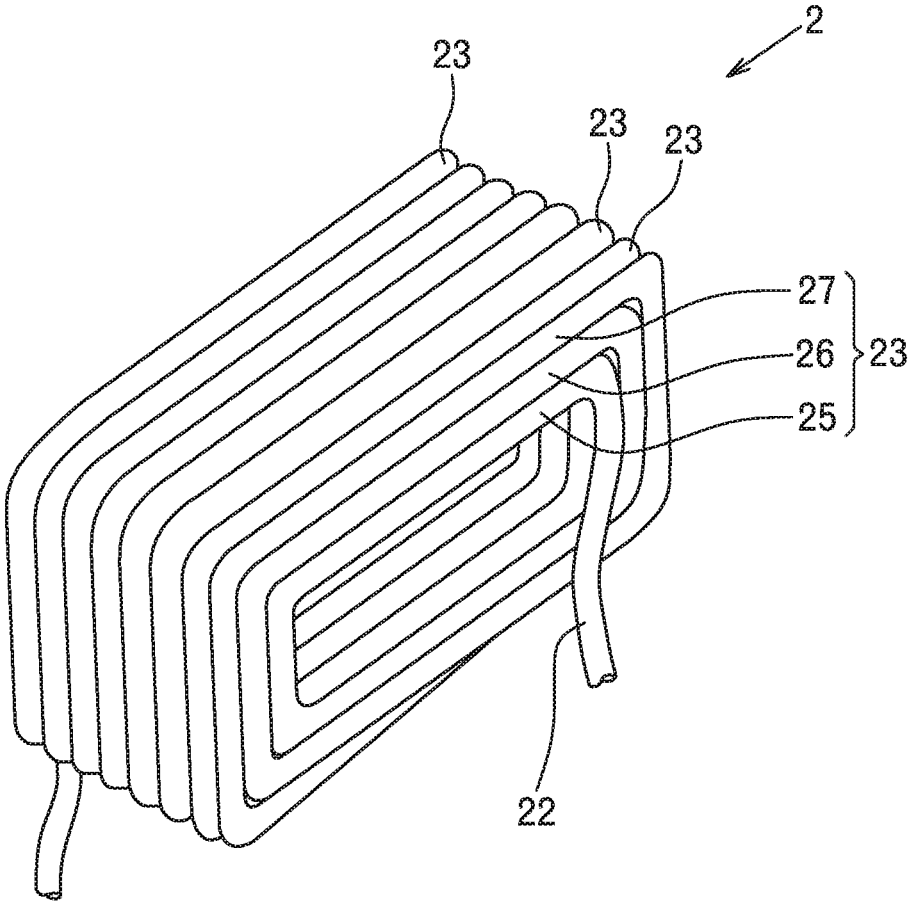
FIG. 17 is a perspective view of a finished state of the coil.

As shown in FIGS. 10 and 11, the second shaft portion 52 of the shaft body 5 has an outer diameter obtained by adding a double of an outer diameter of the conductive wire to an outer diameter of the first shaft portion 51, and the third shaft portion 53 has an outer diameter obtained by adding the double of the outer diameter of the conductive wire to the outer diameter of the second shaft portion 52.

Figure 7:
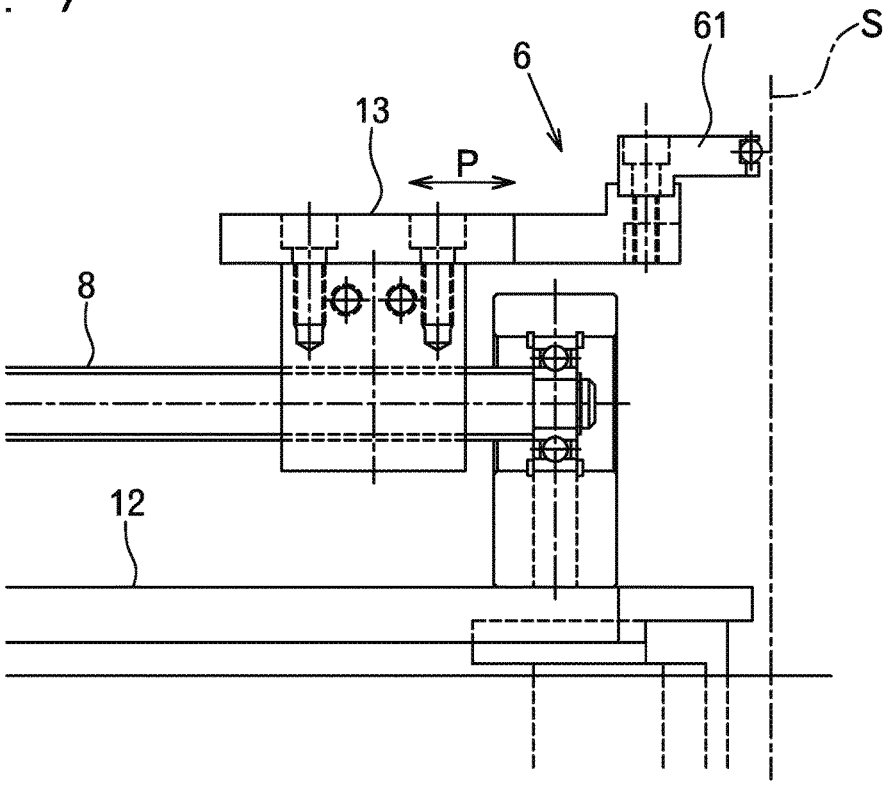
FIG. 7 is a front view of a bending mechanism.
Figure 8:
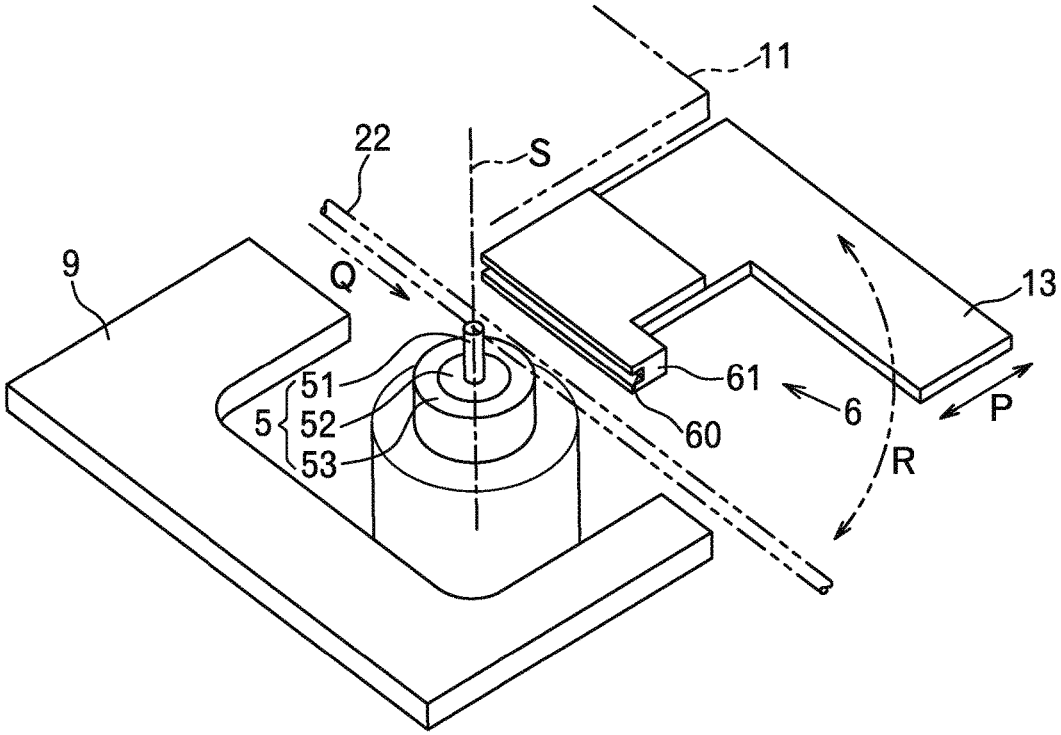
FIG. 8 is a perspective view of the shaft body and the bending mechanism.

As shown in FIGS. 6 and 8, the rotation platform 12 forming the bending mechanism 6 reciprocates and moves along a circumference line R about the winding axis S of the conductive wire. As shown in FIGS. 7 and 8, the second reciprocating platform 13 on the rotation platform 12 reciprocates and moves along a straight route P coming close to or away from the winding axis S of the conductive wire. Thereby, the pressing member 61 forming the bending mechanism 6 comes close to or away from the shaft body 5, and is rotated about the shaft body 5.

As shown in FIG. 8, a recessed groove 60 extending along the transition path of the conductive wire 22 is formed in the pressing member 61. A U shape guide plate 9 is installed at a position in the vicinity of the shaft body 5.

In a winding step by the winding apparatus, as shown in FIG. 8, by bringing the first reciprocating platform 11 forward, the conductive wire 22 is moved in parallel to a position where the conductive wire 22 is fitted along an outer circumferential surface of the first shaft portion 51, the second shaft portion 52, or the third shaft portion 53 of the shaft body 5, and by bringing the second reciprocating platform 13 forward, the pressing member 61 is brought forward to a position where the pressing member can press the conductive wire 22. In this state, firstly, the conductive wire 22 is transferred by a predetermined distance. The transfer distance of the conductive wire 22 is set to be size in accordance with lengths of four sides in a unit wound portion to be formed.

Next, by rotating the pressing member 61 by a predetermined rotation angle θ exceeding 90 degrees from an initial position where the pressing member 61 is fitted along the conductive wire 22, the conductive wire 22 is bent by 90 degrees while being fitted along the outer circumferential surface of the first shaft portion 51, the second shaft portion 52, or the third shaft portion 53 of the shaft body 5. It should be noted that by setting the rotation angle θ of the pressing member 61 to be slightly larger than 90 degrees, the conductive wire 22 has a bending angle of 90 degrees by springback. In this bending process of the conductive wire 22, the conductive wire 22 extending over the shaft body 5 slides along a surface of the guide plate 9.

The guide plate 9 has an inclination angle in accordance with a lead angle of the unit wound portion. When the conductive wire 22 slides along the surface of the guide plate 9, a predetermined lead angle is provided to the conductive wire 22.

By repeating a transfer step and a bending step of the above conductive wire 22 four times, one unit wound portion having four arc shape corner parts is formed.

In a state where the shaft portion of the shaft body 5 on which the conductive wire 22 is to be wound is changed with the other shaft portion having a different outer diameter, and the first reciprocating platform 11 and the second reciprocating platform 13 are moved forward and rearward in accordance with the outer diameter of the shaft portion, by similarly repeating the transfer step and the bending step of the conductive wire 22 four times, the next unit wound portion having four arc shape corner parts is formed.

In such a way, three unit wound portions having different inner circumferential lengths are wound, and thereby, one unit coil portion is formed. As shown in FIG. 10, at the time of forming a first unit wound portion 25, only the first shaft portion 51 of the shaft body 5 protrudes and the conductive wire is wound on the outer circumferential surface thereof, at the time of forming a second unit wound portion 26, the second shaft portion 52 protrudes and the conductive wire is wound on the outer circumferential surface thereof, and at the time of forming a third unit wound portion 27, the third shaft portion 53 protrudes and the conductive wire is wound on the outer circumferential surface thereof.

Thereby, as shown in FIG. 11, the corner part of the first unit wound portion 25 formed by winding the conductive wire on the outer circumferential surface of the first shaft portion 51 of the shaft body 5, the corner part of the second unit wound portion 26 formed by winding the conductive wire on the outer circumferential surface of the second shaft portion 52, and the corner part of the third unit wound portion 27 formed by winding the conductive wire on the outer circumferential surface of the third shaft portion 53 have common curvature center matching the winding axis S.

Further, by repeating a formation step of the above unit coil portion, as shown in FIG. 10, with the first unit wound portion 25, the second unit wound portion 26, and the third unit wound portion 27 as one unit coil portion 23, the interim product 20 of the air core coil in which the unit coil portions 23 are repeatedly formed can be obtained.

FIGS. 12 to 16 show a series of actions of the winding apparatus according to the present invention. In Step S1 of FIG. 12, the conductive wire 22 is fitted along the outer circumferential surface of the first shaft portion 51 and the pressing member 61 is fitted along the conductive wire 22. Next, after the conductive wire 22 is transferred by a predetermined distance (length of a long side of the unit wound portion) in Step S2, the pressing member 61 is rotated and the conductive wire 22 is bent in Step S3. Thereby, a first arc shape corner part in accordance with the outer diameter of the first shaft portion 51 is formed.

Next, as in Step S4, the pressing member 61 is returned to the initial position. After the conductive wire 22 is transferred by a predetermined distance (length of a short side of the unit wound portion) in Step S5, the pressing member 61 is rotated and the conductive wire 22 is bent in Step S6. Thereby, a second arc shape corner part in accordance with the outer diameter of the first shaft portion 51 is formed.

Next, as in Step S7, the pressing member 61 is returned to the initial position. After the conductive wire 22 is transferred by a predetermined distance (length of the long side of the unit wound portion) in Step S8 of FIG. 13, the pressing member 61 is rotated and the conductive wire 22 is bent in Step S9. Thereby, a third arc shape corner part in accordance with the outer diameter of the first shaft portion 51 is formed.

Then, as in Step S10, the pressing member 61 is returned to the initial position. After the conductive wire 22 is transferred by a predetermined distance (length of the short side of the unit wound portion) in Step S11, the pressing member 61 is rotated and the conductive wire 22 is bent in Step S12. Thereby, a fourth arc shape corner part in accordance with the outer diameter of the first shaft portion 51 is formed, and the first unit wound portion 25 is wound.

Then, as in Step S13, the pressing member 61 is returned to the initial position. After the conductive wire 22 is transferred by a predetermined distance (length of the long side of the unit wound portion) in Step S14 of FIG. 14, the first reciprocating platform 11 and the second reciprocating platform 13 are retreated by a distance in accordance with the outer diameter of the conductive wire 22 in Step S15. Next, after the second shaft portion 52 is raised as in Step S16, the pressing member 61 is rotated and the conductive wire 22 is bent in Step S17. Thereby, a first arc shape corner part in accordance with the outer diameter of the second shaft portion 52 is formed.

Then, as in Step S18, the pressing member 61 is returned to the initial position. After the conductive wire 22 is transferred by a predetermined distance (length of the short side of the unit wound portion) in Step S19, the pressing member 61 is rotated and the conductive wire 22 is bent in Step S20 of FIG. 15. Thereby, a second arc shape corner part in accordance with the outer diameter of the second shaft portion 52 is formed.

Then, as in Step S21, the pressing member 61 is returned to the initial position. After the conductive wire 22 is transferred by a predetermined distance (length of the long side of the unit wound portion) in Step S22, the pressing member 61 is rotated and the conductive wire 22 is bent in Step S23. Thereby, a third arc shape corner part in accordance with the outer diameter of the second shaft portion 52 is formed.

Then, as in Step S24, the pressing member 61 is returned to the initial position. After the conductive wire 22 is transferred by a predetermined distance (length of the short side of the unit wound portion) in Step S25, the pressing member 61 is rotated and the conductive wire 22 is bent in Step S26 of FIG. 16. Thereby, a fourth arc shape corner part in accordance with the outer diameter of the second shaft portion 52 is formed, and the second unit wound portion 26 is wound.

Then, as in Step S27, the pressing member 61 is returned to the initial position. After the conductive wire 22 is transferred by a predetermined distance (length of the long side of the unit wound portion) in Step S28, the first reciprocating platform 11 and the second reciprocating platform 13 are retreated by the distance in accordance with the outer diameter of the conductive wire 22 in Step S29. Next, after the third shaft portion 53 is raised as in Step S30, the pressing member 61 is rotated and the conductive wire 22 is bent in Step S31. Thereby, a first arc shape corner part in accordance with the outer diameter of the third shaft portion 53 is formed.

By repeating the same actions, the third unit wound portion 27 is wound, and the first unit coil portion 23 is formed. Next, the wound shaft is changed in order of the third shaft portion 53, the second shaft portion 52, and the first shaft portion 51, and while bringing the first reciprocating platform 11 and the second reciprocating platform 13 forward by the distance in accordance with the outer diameter of the conductive wire 22, the third unit wound portion 27, the second unit wound portion 26, and the first unit wound portion 25 are wound in this order, so that the next unit coil portion 23 is formed. By repeating this formation of the unit coil portion 23, the interim product 20 of the air core coil shown in FIG. 10 is finished.

In the above winding apparatus, the guide plate 9 shown in FIG. 8 has the inclination angle in accordance with the lead angle of the unit wound portion. Thus, every time when the pressing member 61 is rotated, the lead angle is provided to the conductive wire 22, and every time when one unit wound portion is formed, the unit wound portion is pushed up by one pitch, so that winding of the interim product 20 is advanced toward the vertically upper side as shown in FIG. 10.

Figure 18A:
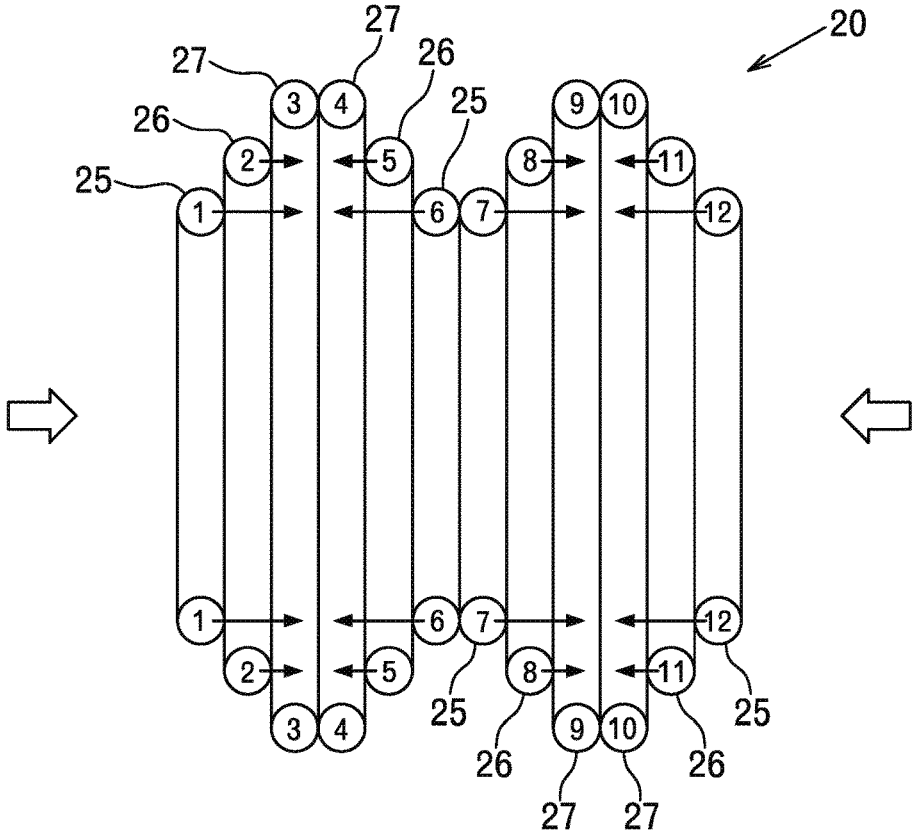
FIG. 18 A is a view showing a compression step where a finished product is obtained from the interim product of the coil.
Figure 18B:
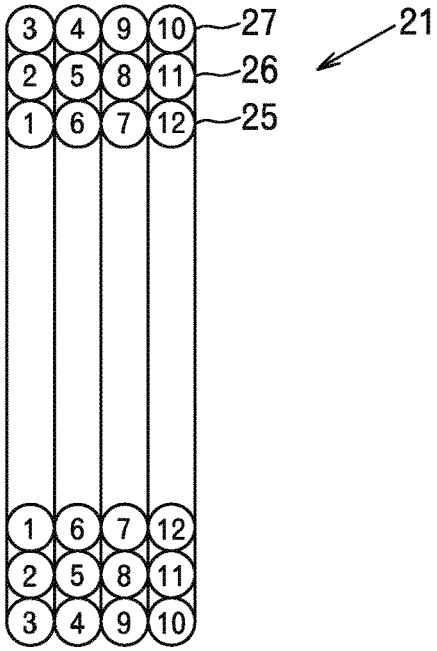

By compressing the interim product 20 of the air core coil obtained as above in the winding axis direction as shown in FIGS. 18 A, 18 B, a finished product 21 of a three-layer coil is obtained. In the finished product 21, the second unit wound portion 26 is pushed inside the third unit wound portion 27, and the first unit wound portion 25 is pushed inside the second unit wound portion 26.

In the interim product 20 of the air core coil manufactured by the above winding method and the winding apparatus, as shown in FIG. 11, in the first unit wound portion 25, the second unit wound portion 26, and the third unit wound portion 27 each forming the unit coil portion, three corner parts formed at the same phase angle with respect to the winding axis S are formed in an arc shape having the curvature center at the same position S. Therefore, a space between the unit wound portions in the corner parts of a coil 2 serving as the finished product becomes zero, and a space factor of the conductive wire is increased.

The coil 2 serving as the finished product functions as a reactor in a state where a core (not shown) is inserted into a center hollow part thereof, or is used as a primary wire or a secondary wire of an electric transformer.

It should be noted that the configurations of the parts of the present invention are not limited to the above embodiment but can be variously modified within the technical scope described in the claims. For example, the conductive wire 22 is not limited to a round wire but may be a square wire having a rectangular section.

DESCRIPTION OF REFERENCE CHARACTERS

2 Coil
20 Interim product
21 Finished product
22 Conductive wire
23 Unit coil portion
25 First unit wound portion
26 Second unit wound portion
27 Third unit wound portion
1 Base
11 First reciprocating platform
12 Rotation platform
13 Second reciprocating platform
3 Conductive wire feeding mechanism
4 Conductive wire transfer mechanism
5 Shaft body
51 First shaft portion
52 Second shaft portion
53 Third shaft portion
6 Bending mechanism
61 Pressing member
62 Motor
7 First driving and reciprocating mechanism
8 Second driving and reciprocating mechanism
9 Guide plate
S Winding axis

What is claimed is:

1. A winding method of a coil in which a plurality of unit wound portions having different inner circumferential lengths from each other is continuously formed in the winding axis direction, each of the unit wound portions is wound along a loop shape winding route having a plurality of arc shape corner parts, and unit coil portions including the pluralities of unit wound portions are continuously formed in the winding axis direction, the method comprising:

a first step of transferring a conductive wire by a predetermined distance along a straight transition path crossing a shaft body, and fitting the conductive wire along an outer circumferential surface of the shaft body; and a second step of winding the conductive wire on the outer circumferential surface of the shaft body by rotating a pressing member to be pressed onto the conductive wire along a circumferential route about the shaft body, so as to form arc shape corner parts, wherein one unit wound portion is formed by repeating the first step and the second step by the number of times of the corner parts, and by changing an outer diameter of the shaft body at the time of formation of the corner parts in a process of forming one unit wound portion, the pluralities of corner parts formed at the same phase angle with respect to the winding axis in the plurality of unit wound portions forming the unit coil portion are formed in an arc shape having curvature center at the same position.

2. The winding method of the coil according to claim 1, wherein the shaft body is formed by a plurality of shaft portions arranged on the same axis as the winding axis, and the outer diameter of the shaft body is changed by, with respect to the center shaft portion, raising and lowering the other shaft portions.

3. The winding method of the coil according to claim 1, comprising: a third step of, after manufacturing the coil in which the unit coil portions including the pluralities of unit wound portions are continuously formed in the winding axis direction, by adding compression force from both sides of the winding axis direction, pushing at least a part of the unit wound portion having a small inner circumferential length inside the unit wound portion having a large inner circumferential length among the plurality of unit wound portions forming the unit coil portion.

* * * * *